US006964433B2

(12) United States Patent
Plutsky

(10) Patent No.: US 6,964,433 B2
(45) Date of Patent: Nov. 15, 2005

(54) REINFORCEMENT MEMBER FOR ALBUMS

(75) Inventor: Sheldon Plutsky, Chatsworth, CA (US)

(73) Assignee: Pioneer Photo Albums, Inc., Chatsworth, CA (US)

( * ) Notice: Subject to any disclaimer, the term of this patent is extended or adjusted under 35 U.S.C. 154(b) by 51 days.

(21) Appl. No.: 10/703,897

(22) Filed: Nov. 6, 2003

(65) Prior Publication Data

US 2005/0099000 A1 May 12, 2005

(51) Int. Cl.[7] ..... B42D 1/00

(52) U.S. Cl. ..... 281/21.1; 281/15.1; 281/29; 402/70; D19/26; D19/32; D19/33

(58) Field of Search ..... 281/15.1, 21.1, 281/29, 36–38, 51; 402/70, 73, 80 R, 80 P, 500, 502; D19/26, 27, 32, 33

(56) References Cited

U.S. PATENT DOCUMENTS 1,293,807 A * 2/1919 Krohmer ..... 281/27.3
1,561,995 A * 11/1925 Pearson ..... 281/21.1
1,819,937 A * 8/1931 Williams ..... 402/14
2,526,270 A * 10/1950 Phillips ..... 281/21.1
3,251,260 A * 5/1966 Serdechny ..... 411/338
4,498,828 A * 2/1985 Ackerman ..... 412/4
4,930,927 A * 6/1990 Dumas ..... 402/63
5,158,387 A * 10/1992 Davies ..... 402/76
5,674,021 A * 10/1997 Hutnick ..... 402/14
5,718,530 A * 2/1998 Tibbetts ..... 402/73
5,785,445 A * 7/1998 Podosek et al. ..... 402/73
6,047,990 A * 4/2000 Mogelonsky et al. ..... 281/29
6,179,332 B1 * 1/2001 Funkhouser ..... 281/21.1
6,361,236 B1 * 3/2002 Podosek ..... 402/70

* cited by examiner

*Primary Examiner*—Monica S. Carter
(74) *Attorney, Agent, or Firm*—Jeffer Mangels Butler & Marmaro, LLP

(57) ABSTRACT

A photo album is disclosed having a cover, a fastener threaded through the cover, and a reinforcement member positioned between the fastener and the cover. The reinforcement member is preferably made of plastic, and more preferably made of rigid plastic.

9 Claims, 2 Drawing Sheets

REINFORCEMENT MEMBER FOR ALBUMS

FIELD OF THE INVENTION

The present invention relates generally to a reinforcement member, and more particularly, to a reinforcement member used in connection with albums, such as photo albums and memory books.

BACKGROUND OF THE INVENTION

As shown in FIG. 1, photo album 100 is generally provided in book form, having a front cover 102, a back cover 104 and a number of sheets 106 therebetween, wherein each sheet of the photo album is configured to hold one or more photographs. Photo albums are typically adjustable to enable the user to add or remove sheets. FIG. 1 depicts a known manner of assembling the photo album to secure the front cover, the sheets and the back cover to each other to form a book.

As shown in FIG. 1, the front cover 102 includes a front flap 110 and the back cover 104 includes a back flap 112. A first fastener 114 is threaded through a hole 118 in the front flap 110, a second fastener 116 is threaded through a hole 120 in the back flap 112, and each fastener 114, 116 is also threaded through holes 108 in the album sheets 106. The first and second fasteners 114, 116 are preferably mateable and when fastened together, will hold the sheets 106 between the front and back covers 102, 104. In a known album, one of the fasteners is internally threaded and the other fastener is externally threaded in a manner that allows for the fasteners to be securely mated. Furthermore, in the known album, the fasteners are generally made of metal, the album sheets are made of a soft plastic, and the front and back covers, including the flaps, are made of cardboard.

Most people prefer to have a photo album that can last for years. Albums that contain cherished photographs are often passed on from one generation to another. Therefore, it is desirable to have an album that can last through the years, and sustain environmental conditions and wear caused by repeated use, without substantial deterioration.

The disadvantage of the known album, described above, is that through repeated use, the fasteners 114, 116 wear through the flaps 110, 112 of the front and back covers. Specifically, at the location where the fasteners contact the flaps, the fasteners begin to wear against the cardboard and make an indentation. Eventually, the holes 118, 120 in the flaps 110, 112 become misshapen. As the holes are worn, the fastener becomes less secure in the hole. At its worst, fasteners 114, 116 are no longer able to securely fasten the sheets 106 to the front and back covers 102, 104. Accordingly, it is desirable to provide an improved photo album that minimizes the wear of the fastener on the flap.

SUMMARY OF PREFERRED EMBODIMENTS

The present invention is directed to an album having a cover, a fastener threaded through the cover, and a reinforcement member positioned between the fastener and the cover. The reinforcement member is preferably made of plastic, and more preferably made of rigid plastic.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE INVENTION

Figure 1:
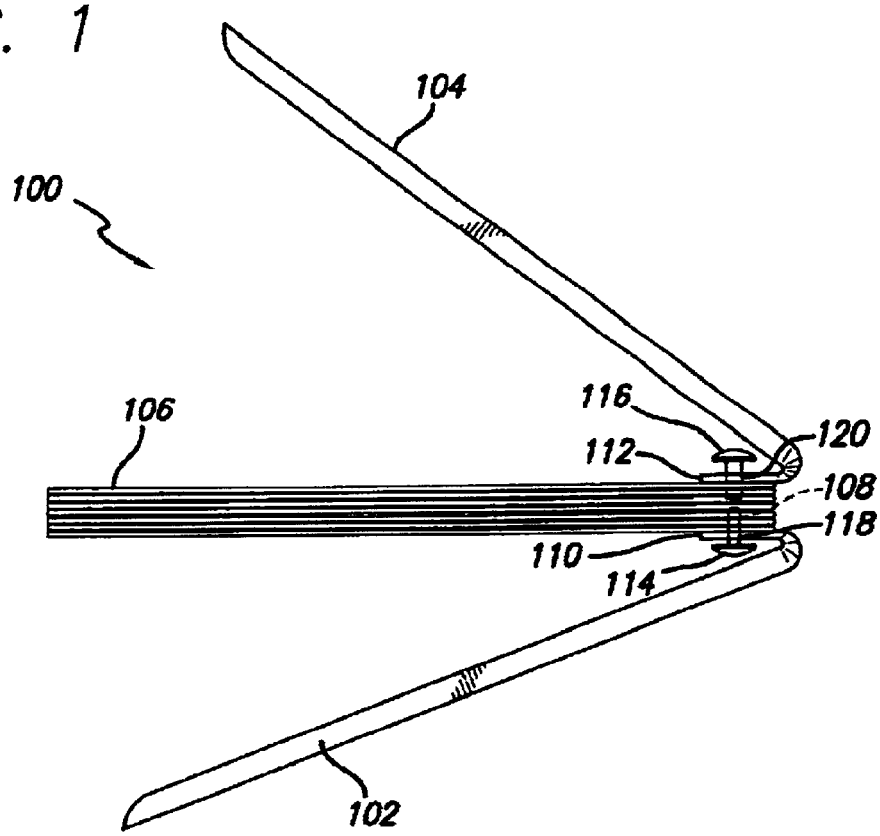
FIG. 1 depicts a known album.
Figure 2:
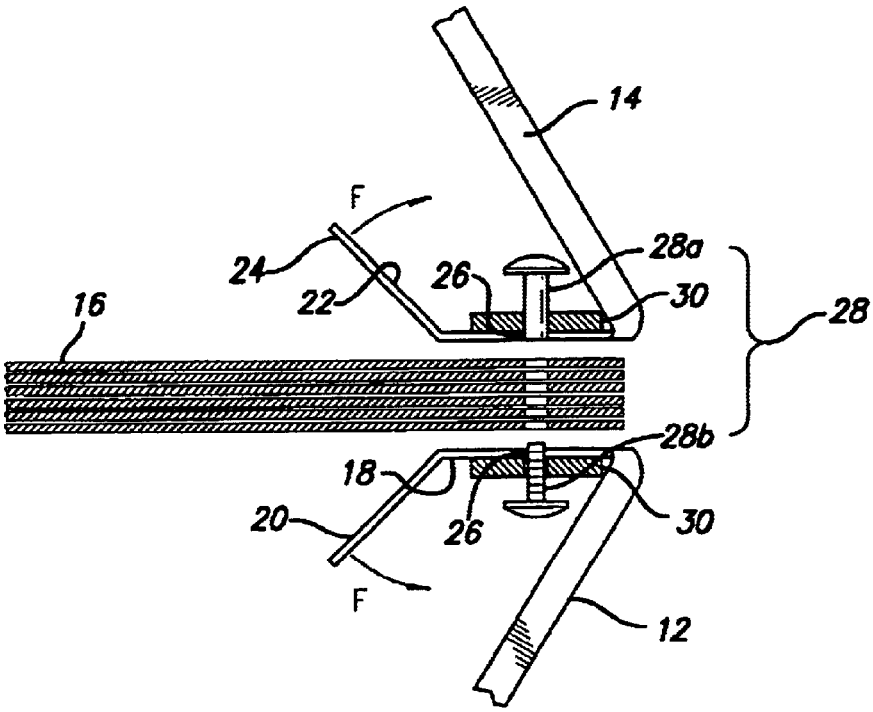
FIG. 2 depicts a preferred embodiment of the album of the present invention.

As shown in FIG. 2, a preferred embodiment of the photo album 10 of the present invention includes a front cover 12, a back cover 14, and a plurality of photo holder sheets 16. The front cover 12 preferably includes a front flap 18 and a front flap cover 20. The back cover 14 preferably includes a back flap 22 and a back flap cover 24. The front cover 12, back cover 14 and sheets 16 each define holes 26 therein for receiving one or more fasteners.

To assemble the photo album, fasteners 28 are threaded through the holes in the front flap 18, back flap 22 and the sheets 16. In the embodiment shown in FIG. 2, the fastener 28 has two parts. The first fastener part 28*a* is internally threaded and the second fastener part 28*b* is externally threaded. The threading of the first and second parts 28*a*, 28*b* is configured to enable the first and second part to securely mate when the threading is engaged. In a preferred embodiment, the first fastener part 28*a* is threaded through one cover and the second fastener part 28*b* is threaded through the other cover. When engaged, the fastener 28 holds the front cover 12, back cover 14 and any sheets 16 therebetween, together. The present invention should not be limited to the fasteners described herein. It is envisioned that any known fasteners that can hold the photo album sheets between a front cover and a back cover can be used.

Figure 3:
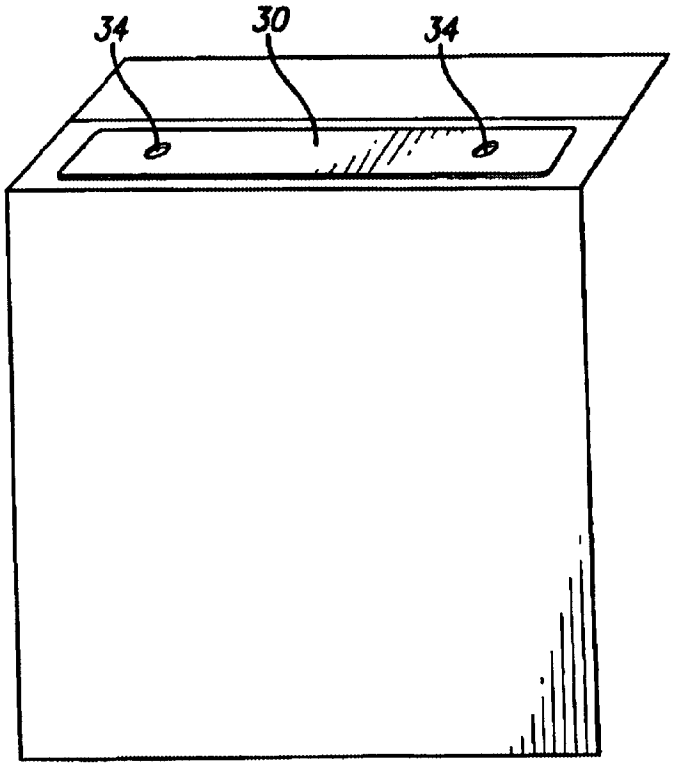
FIG. 3 depicts a preferred embodiment of the reinforcement member of the present invention as installed in an album cover.
Figure 4:
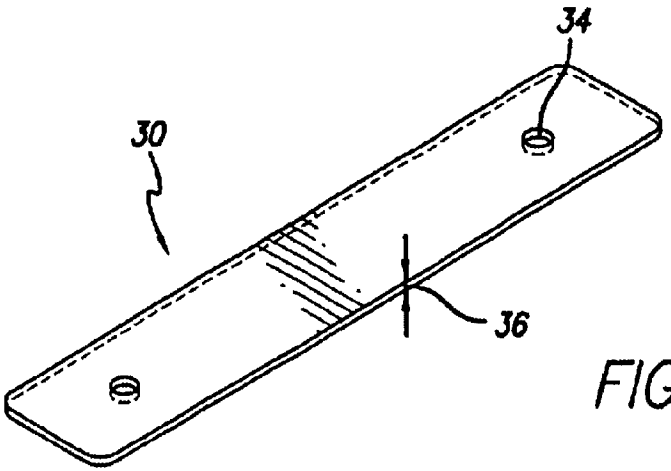
FIG. 4 depicts a perspective view of a preferred embodiment of the reinforcement member of the present invention.

In a preferred embodiment of the invention, a reinforcement member 30 is positioned between the fastener 28 and the flaps 18, 22 to prevent the fastener from damaging or deteriorating the flap. FIG. 2 shows a reinforcement member 30 positioned between the first fastener part 28*a* and the front cover 12, and another reinforcement member 30 positioned between the second fastener part 28*b* and the back cover 14. AS shown in FIG. 3, the reinforcement member 30 is preferably positioned flat against the inside surface 32 of either the front cover or the back cover. Holes 34 in the reinforcement member 30 are aligned with holes 26 in the flap and a fastener is threaded through the aligned holes. In the embodiment shown, the enforcement member 30, the photo sheets 16, and the covers 12, 14 all have two holes 34. However, according to the present invention, the enforcement member 30, the photo sheets 16, and the covers 12, 14 can have any number of holes. Furthermore, the enforcement member 30 shown in FIGS. 3 and 4 is a one-piece structure that is long enough to cover both holes in the cover flap and receive both fasteners. It is envisioned that the enforcement member 30 of the present invention can be in two or more pieces, wherein each piece is large enough to accommodate a single fastener.

In a preferred embodiment of the invention, the flaps 18, 22 are constructed of cardboard or other heavy paper material. The fasteners are typically metal. The positioning of the reinforcement member 30 between the flaps and the fasteners prevents deterioration caused by the fasteners' repeated contact with the flaps. The reinforcement member is preferably made of plastic and, more preferably, made of a rigid plastic. The material of the reinforcement member, however, is not limited to the materials described herein.

The thickness 36 of the reinforcement member 30 can vary depending on the weight and material of the fasteners and flaps. The reinforcement member should have sufficient thickness to protect the flap against deterioration and wear caused by the fasteners.

As shown in FIG. 2, the front flap cover 20 is pivotably connected to the front flap 18 and the back flap cover 24 is pivotably connected to the back flap 22. After the reinforcement member 30 and fastener 28 have been installed, the front flap cover 20 is folded in the direction F toward the front cover 12 to cover the reinforcement member and the fasteners from view. Similarly, back flap cover 24 is folded in the direction F toward the back cover 14 to cover the reinforcement member and the fasteners from view.

The embodiments described above are exemplary embodiments of a reinforcement member for a photo album. The invention is readily applicable to devices similar to photo albums, such as memory books and the like. For purposes of the claims, album shall include photo albums, memory books and the like. Those skilled in the art may now make numerous uses of, and departures from, the above-described embodiments without departing from the inventive concepts disclosed herein. Accordingly, the present invention is to be defined solely by the scope of the following claims.

What is claimed is:

1. An album, comprising:

a front cover having a first flap, the first flap defining a first hole and a second hole spaced apart from the first hole;

a back cover having a second flap, the second flap defining a first hole and a second hole spaced apart from the first hole;

a first fastener configured to be threaded through the first hole of the first flap;

a second fastener mateable with the first fastener configured to be threaded through the first hole in the second flap;

a third fastener configured to be threaded through the second hole of the first flap;

a fourth fastener mateable with the third fastener configured to be threaded through the second hole of the second flap; and a reinforcement member positioned between the first fastener and the first flap.

2. The album of claim 1 wherein the reinforcement member is positioned between the third fastener and the first flap.

3. The album of claim 2 comprising a second reinforcement member positioned between the second fastener and the second flap.

4. The album of claim 3 wherein the second reinforcement member is positioned between the fourth fastener and the second flap.

5. The album of claim 1 wherein the album is a photo album.

6. The album of claim 1 wherein the album is a memory book or the like.

7. An album, comprising:

a cover having a first hole;

first and second fasteners, wherein said first and second fasteners are mateable with one another;

at least one sheet positioned between said first and second fasteners, the sheet having a second hole, the second fastener being aligned with the second hole; and a reinforcement member positioned between he first fastener and the cover, the reinforcement member having a third hole;

wherein the first fastener is inserted through the first hole, the second hole and the third hole.

8. An album, comprising:

a front cover having a first flap, the first flap defining a first flap hole;

a back cover having a second flap, the second flap defining a second flap hole;

a first fastener configured to be inserted through the first flap hole;

a second fastener mateable with the first fastener and configured to be inserted through the second flap hole; and a reinforcement member positioned between the first fastener and the first flap.

9. The album of claim 8, further comprising a second reinforcement member positioned between the second fastener and the second flap.

* * * * *